US007992575B2

(12) United States Patent
Cui et al.

(10) Patent No.: US 7,992,575 B2
(45) Date of Patent: Aug. 9, 2011

(54) USE OF CHLORATE, SULFUR OR OZONE TO REDUCE TOBACCO SPECIFIC NITROSAMINES

(75) Inventors: Mingwu Cui, Lexington, KY (US); Mark T. Nielsen, Nicholsville, KY (US); Robert F. Hart, III, Winchester, KY (US); Michael L. Overbey, Murray, KY (US); David J. Watson, Murray, KY (US); John R. Chipley, Brentwood, TN (US)

(73) Assignee: U.S. Smokeless Tobacco Company, Richmond, VA (US)

( * ) Notice: Subject to any disclaimer, the term of this patent is extended or adjusted under 35 U.S.C. 154(b) by 1266 days.

(21) Appl. No.: 11/363,664

(22) Filed: Feb. 28, 2006

(65) Prior Publication Data

US 2006/0196516 A1 Sep. 7, 2006

Related U.S. Application Data

(60) Provisional application No. 60/657,649, filed on Feb. 28, 2005.

(51) Int. Cl.
*A24B 3/10* (2006.01)

(52) U.S. Cl. ..... 131/290

(58) Field of Classification Search ..... None
See application file for complete search history.

(56) References Cited

U.S. PATENT DOCUMENTS 0,158,015 A 12/1874 Barton
2,094,614 A 10/1937 Miller
3,474,792 A * 10/1969 Kennedy et al. ..... 131/352
4,127,136 A * 11/1978 Comber ..... 131/290
4,343,318 A 8/1982 Brenik et al.
4,516,590 A 5/1985 Teng
4,528,993 A 7/1985 Sensabaugh et al.
4,660,577 A 4/1987 Sensabaugh et al.
4,730,628 A 3/1988 Townsend et al.
4,848,373 A 7/1989 Lenkey
4,889,638 A * 12/1989 Rockford et al. ..... 210/703
4,917,161 A 4/1990 Townend
4,941,485 A 7/1990 Perfetti et al.

(Continued)

FOREIGN PATENT DOCUMENTS

GB 1189880 4/1970

(Continued)

OTHER PUBLICATIONS

Cooperative Extension Offices of Cornell Univeristy, Oregon State University, the University of Idaho, the University of California at Davis, and Michigan State Univeristy, "Extension Toxicology Network, Pesticide Information Profiles: Sodium Chlorate", Sep. 1995, Oregon State Univeristy, http://extoxnet.orst.edu/pips/sodiumch.htm, accessed Sep. 12, 2009.*

(Continued)

*Primary Examiner* — Richard Crispino
*Assistant Examiner* — Michael J Felton
(74) *Attorney, Agent, or Firm* — Fish & Richardson P.C.

(57) ABSTRACT

A method is provided for reducing levels of tobacco specific nitrosamines (TSNA) in tobacco during barn curing. The method includes contacting tobacco with chlorate, sulfur, ozone or combinations thereof in amounts effective for controlling or reducing bacterial an/or fungal populations on or in tobacco.

7 Claims, 2 Drawing Sheets

U.S. PATENT DOCUMENTS

| | | | | |
|---|---|---|---|---|
| 5,039,423 | A | 8/1991 | Kelley | |
| 5,372,149 | A | 12/1994 | Roth et al. | |
| 5,569,833 | A | 10/1996 | Vincentz et al. | |
| 5,611,360 | A | 3/1997 | Tang | |
| 5,984,430 | A | 11/1999 | Koga et al. | |
| 6,083,531 | A | 7/2000 | Humbert et al. | |
| 6,095,152 | A | 8/2000 | Beven et al. | |
| 6,177,096 | B1 | 1/2001 | Zerbe et al. | |
| 6,311,695 | B1 | 11/2001 | Williams | |
| 6,564,808 | B1 * | 5/2003 | Hempfling et al. | 131/297 |
| 6,578,584 | B1 | 6/2003 | Beven et al. | |
| 6,615,842 | B1 | 9/2003 | Cerami et al. | |
| 6,668,839 | B2 | 12/2003 | Williams | |
| 6,740,332 | B2 | 5/2004 | Zyck et al. | |
| 6,755,200 | B1 | 6/2004 | Hempfling et al. | |
| 6,789,548 | B2 | 9/2004 | Bereman | |
| 6,790,671 | B1 | 9/2004 | Austin et al. | |
| 6,792,953 | B2 | 9/2004 | Lesser et al. | |
| 6,805,134 | B2 | 10/2004 | Peele | |
| 6,834,564 | B2 | 12/2004 | Huesges et al. | |
| 6,895,974 | B2 | 5/2005 | Peele | |
| 6,907,887 | B2 | 6/2005 | Conkling | |
| 7,067,116 | B1 | 6/2006 | Bess et al. | |
| 7,293,564 | B2 | 11/2007 | Perfetti et al. | |
| 2001/0051591 | A1 | 12/2001 | Ferrett et al. | |
| 2004/0025894 | A1 | 2/2004 | Beven et al. | |
| 2005/0034365 | A1 | 2/2005 | Li et al. | |
| 2005/0115580 | A1 | 6/2005 | Quinter et al. | |
| 2005/0121046 | A1 * | 6/2005 | Hempfling et al. | 131/347 |
| 2005/0244521 | A1 | 11/2005 | Strickland et al. | |
| 2006/0196516 | A1 | 9/2006 | Cui et al. | |
| 2007/0149408 | A1 | 6/2007 | Thomas et al. | |

FOREIGN PATENT DOCUMENTS

| | | | |
|---|---|---|---|
| GB | 2265297 | A | 9/1993 |
| WO | WO 01/35770 | | 5/2001 |
| WO | WO 02/13636 | | 2/2002 |
| WO | WO 2004/068973 | | 8/2004 |
| WO | WO 2005/041699 | | 5/2005 |

OTHER PUBLICATIONS

Lewis, Richard J., Sr. Hawley's Condensed Chemical Dictionary (15th Edition) 2007. (pp: 1028). John Wiley & Sons. Online version available at: http://knovel.com/web/portal/browse/display?_EXT_KNOVEL_DISPLAY_bookid=2822&VerticalID=0.*

Safe Drinking Water Committe, National Research Council; "Drinking Water and Health, vol. 2", 1977, p. 14, National Academies Press. Availble online:http://books.google.com/books?id=oXIrAAAAYAAJ&Ipg=PR1&pg=PR1#v=onepage&q&f=false.*

Noss et al., "Disinfecting Capabilities of Oxychlorine Compounds," *Appl. Enviro. Microbiology*, Nov. 1985; vol. 50(5): pp. 1162-1164.

*Tobacco: Production, Chemistry and Technology*, Blackwell Publishing, 1999; pp. 15-21.

Peedin, "Production Practices. 5A Flue-cured Tobacco," Tobacco: Production, Chemistry and Technology, 1999, Davis & Nielsen (eds.), Blackwell Science, Chapter 5, p. 104-182.

Leffingwell, "Leaf Chemistry," Tobacco: Production, Chemistry and Technology, 1999, Davis & Nielsen (eds.), Blackwell Science, Chapter 8, pp. 265-312.

Wehlburg, "Cigars and Cigarillos," Tobacco: Production, Chemistry and Technology, 1999, Davis & Nielsen (eds.), Blackwell Science, Chapter 13, pp. 440-451.

Wahlberg and Ringberger "Smokeless Tobacco" Tobacco Production, Chemistry and Technology, 1999, Chapter 14, pp. 452-460.

"Seed to Smoke," Tobacco: Production, Chemistry and Technology, Davis & Nielsen (eds.), Blackwell Science, 1999, p. 19-20.

"Determination of Nicotine, pH, and Moisture Content of Six U.S. Commercial Moist Snuff Products—Florida, Jan.-Feb. 1999," http://findarticles_com/p/articles/mi_m0906/is_19_48/ai_54729071/ print, printed Aug. 28, 2007, 6 pgs.

"Smokeless Tobacco Fact Sheets," 3rd Int'l Conference on Smokeless Tobacco, Stockholm, Sweden, Sep. 22-25, 2002, 24 pages.

Bush et al., "Formation of Tobacco-Specific Nitrosamines in Air-Cured Tobacco," Recent Advances in Tobacco Science, 2001, 27:23-46.

Callaway et al., "Effects of Sodium Chlorate on Antibiotic Resistance in *Escherichia coli* 0157:H7," Foodborne Pathogens and Disease, 2004, 1:59-63.

Cui et al., "Factors in Tobacco-Specific N-Nitrosamine Accumulation in Tobacco," Tobacco Science Research Conference 50, 1996, Abstr. 74.

Cui, "The source and the regulation of nitrogen oxide production for tobacco specific nitrosamine formation during air-curing tobacco," Ph.D. dissertation, 1998, University of Kentucky, 178 pages.

Di Giacomo et al., "Microbial Community Structure and Dynamics of Dark Fire-Cured Tobacco Fermentation," Applied and Environ. Microbiol., 2007, 73(3):825-837.

Rusmana and Nedwell, "Use of chlorate as a selective inhibitor to distinguish membrane-bound nitrate reductase (Nar) and periplasmic nitrate reductase (Nap) of dissimilative nitrate reducing bacteria in sediment," FEMS Microbiology Ecology, 2004, 48:379-386.

HHS Ingredients List, http://www.forsythtobacco.com/Tlcig_ingred_list.asp, printed 8/2712007, 32 pgs.

Hoffmann and Djordjevic, "Chemical Composition and Carcinogenicity of Smokeless Tobacco," Adv. Dent. Res., 1997, 11:322-329.

Hakk et al., "Tissue Residues, Metabolism, and Excretion of Radiolabeled Sodium Chlorate (Na[36CI]O3) in Rats," J. Agric. Food Chem., 2007, 55:2034-2042.

Anderson et al., "Bactericidal Effect of Sodium Chlorate on *Escherichia coli* 0157:H7 and Salmonella Typhimurium DT104 in Rumen Contents in Vitro," J. Food Protection, 2000, 63(8):1038-1042.

Anderson et al., "Effect of Sodium Chlorate on Salmonella Typhimurium Concentrations in the Weaned Pig Gut," J. Food Protection, 2001, 64(2):255-258.

Anderson et al., "Bactericidal Effect of Sodium Chlorate on *Escherichia coli* Concentrations in Bovine Ruminal and Fecal Contents in Vivo," Microbial Ecol. Health Dis., 2002, 14:24-29.

Steel et al., "Bacterial survey of curing tobaccos," 54th Tobacco Science Research Conference, Abst. 20, Sep. 25, 2000.

Davis et al. "Tobacco production, chemistry and technology" World Agricultural Series, 1999 Coresta, ISNB-0-632-04791-7, 33 pages.

* cited by examiner

USE OF CHLORATE, SULFUR OR OZONE TO REDUCE TOBACCO SPECIFIC NITROSAMINES

This application claims the benefit of U.S. Provisional Application No. 60/657,649, filed on Feb. 28, 2005.

FIELD OF THE INVENTION

The present invention is directed to a method for reducing and controlling levels of tobacco specific nitrosamines (TSNA) in tobacco during barn curing. More specifically, chlorate, sulfur, ozone or combinations thereof are contacted with tobacco in amounts effective for controlling or reducing bacterial and/or fungal populations on or in tobacco.

BACKGROUND

Tobacco specific nitrosamines (TSNA) are generally considered to be undesirable constituents that occur naturally in cured or dried leaves of tobacco. Tobacco specific nitrosamines, including N'-nitrosonomicotine (NNN), N'-nitrosoanatabine (NAT), N'-nitrosoanabasine (NAB), and 4-(methylnitrosamino)-1-(3-pyridyl)-1-butanone (NNK), are the direct result of a chemical reaction between certain tobacco alkaloids that are endogenous to tobacco and unstable $NO_x$ radicals, such as nitrite ($NO_2$), that are formed readily in tobacco during the curing process (Cui M., Yang, H., Bush, L. P. and Burton, H., *Tob. Sci. Res. Conf.* 50, Abstr. 74, 1996). It is generally understood that microbes on or in the tobacco plant before, during, and after curing are most responsible for the formation of nitrite ($NO_2$), the predominant $NO_x$ precursor for TSNA formation (Bush L. P., M. Cui, H. R. Burton, F. F. Fannin, L. Lei, and N. Dye, *Recent Advances in Tobacco Science,* 27, 23-46, 2001). Reducing the microbial population during tobacco curing may limit substrate ($NO_2$) availability and result in lower levels of TSNAs.

Tobacco harvested from the field is cured using a variety of practices that may include natural air-curing, forced, heated air-curing known as flue-curing, and fire-curing, a process in which wood or wood by-products such as sawdust are ignited to produce heat and smoke within the curing structure (Tso T. C., *Production, physiology and biochemistry of tobacco plant*, IDEALS Inc. Beltsville, Md., 1990.; Davis D. L and M. T. Nielsen, *Tobacco production, chemistry and technology* (World Agricultural Series, 1999 CORESTA, ISBN-0-632-04791-7), 1999). Tobacco curing is a process of physical and biochemical changes that bring out the aroma and flavor of each variety of tobacco. The physical changes are witnessed by moisture reduction and color change. The biochemical changes are witnessed by the degradation of chlorophyll that brings leaves their yellow appearance and the converting starch into sugar (Tso T. C., *Production, physiology and biochemistry of tobacco plant*, IDEALS Inc. Beltsville, Md., 1990.; Davis D. L. and M. T. Nielsen, *Tobacco production, chemistry and technology* (World Agricultural Series, 1999 CORESTA, ISBN-0-632-04791-7), 1999). Curing involves three essential steps: yellowing, browning (leaf drying) and stem drying. The yellowing stage is a continuation of the ripening process and is thought to be the most important part of the curing process. The leaf is still biochemically active till the end of yellowing, which allows it to carry on certain biological processes needed to convert starch to sugar and break down chlorophyll. The browning stage is also called leaf drying, where the lamina tissue is dried to a particular moisture level. Lamina color is fixed at the end of browning.

The stem drying stage is referred to as the final drying process where extra moisture is removed from the stem At the initiation of curing, the harvested tobacco is considered to be green tissue that has cell integrity, is capable of mobilizing reduced nitrogen (nitrite), and has intra-cellular compartmentalization that separates the substrates required for TSNA formation. The loss of moisture, the hydroxylation and depletion of reserve metabolites, and the continuous degradation of functional protein lead to the loss of membrane integrity, and consequently, to the loss of cell compartmentalization. Cellular degradation and moisture loss provides the opportunity for exogenous microbes to directly contact the substrates for TSNA formation. These exogenous microbes produce the $NO_x$ substrate that combines with the endogenous secondary amine alkaloids to form TSNAs during the tobacco curing process and during various types of leaf storage.

Bacterial populations on tobacco leaves are known to grow exponentially (after a "lag") during curing as observed in traditional curing practices. Bacteria gain entrance into the tobacco leaf in large numbers through stomata or cracks formed in the leaf cuticle by tissue necrosis, particularly during lamina and stem drying of the tobacco. Bacteria also gain entrance into the tobacco leaf at any time through a damaged leaf cuticle. Damage to the leaf cuticle may occur in the field, during harvesting, during leaf transport or during curing.

The bacterial population of tobacco leaves, both primed and stalk-cut, when harvested is about $10^5$ to $10^6$ bacteria/gram of dry weight of tobacco leaf (Bush L. P., M. Cui, H. R. Burton, F. F. Fannin, L. Lei, and N. Dye, *Recent Advances in Tobacco Science,* 27, 23-46, 2001; Steel M. and W. Hempfling, *Tob. Sci. Res. Conf.* 54., Abst#20, 2000). The heat of the yellowing process during flue-curing and the prolonged exposure time of air-curing both result in growth of the bacterial population during yellowing. Bacterial populations may increase by 10 fold or more during this period. Once the leaf loses its membrane integrity, the nitrites react with secondary amines to form TSNA. Hence, the removal or reduction of bacterial populations in tobacco leaves or in a tobacco curing environment is desirable.

Fungi may be present on tobacco plants at harvest, during curing process and after cure. Also, some fungi produce nitrite from nitrate. Therefore, the removal or reduction of fungal growth from tobacco leaves is also desired.

SUMMARY OF THE INVENTION

The present invention is directed to methods for treating tobacco that are effective for reducing TSNA formation and reducing or eliminating bacterial and/or fungal activity that contributes to TSNA formation as compared to untreated tobacco. The treatment methods for controlling or reducing bacterial and/or fungal populations include contacting, tobacco with effective amounts of $ClO_3^-$, $SO_2$, $O_3$ or combinations thereof.

In one aspect, chlorate ($ClO_3^-$) may be applied to tobacco to control or reduce bacterial and/or fungal populations. In accordance with this method, tobacco is contacted with an amount of chlorate effective for controlling or reducing said populations. The chlorate may be applied to the tobacco as a chlorate salt which may include but not limited to sodium chlorate, potassium chlorate, calcium chlorate and mixtures thereof.

Tobacco may be contacted with chlorate that is in a liquid form, solid form or gaseous form. When chlorate is applied to tobacco in a liquid form, the liquid chlorate applied to the tobacco will have a chlorate concentration of about 100 to about 400 ppm in the aqueous solution. Chlorate may also be applied to tobacco in solid form. Chlorate may be applied to the tobacco before harvest, before curing, during curing, after curing, or any combination thereof.

In another aspect, sulfur dioxide ($SO_2$) may be applied to tobacco to control or reduce bacterial and/or fungal populations. In accordance with this method, tobacco is contacted with an amount of sulfur dioxide effective for controlling or reducing said populations. Sulfur dioxide gas may be applied directly to the tobacco or into the curing barn or it may arise from the ignition or burning of sulfur-containing compounds. Sulfur dioxide may be applied to the tobacco before harvest, before curing, during curing, after curing, or any combination thereof. Solid, liquid or gaseous materials effective for providing sulfur dioxide may be used.

In another aspect, ozone ($O_3$) may be used to control or reduce bacterial and/or fungal populations in the tobacco curing environment. In this aspect, tobacco is contacted with an amount of ozone effective for controlling or reducing said populations. More specifically, the tobacco is contacted with from about 0.0005 to about 5.0 ppm, preferably about 0.01 to 0.8 ppm ozone in the gas mixture. The tobacco may be contacted with ozone before harvest, before curing, during curing, after curing, or any combination thereof.

All of these methods provided herein reduce bacterial populations found in and on the tobacco and thus decrease the potential for TSNA formation.

DETAILED DESCRIPTION

Figure 1:
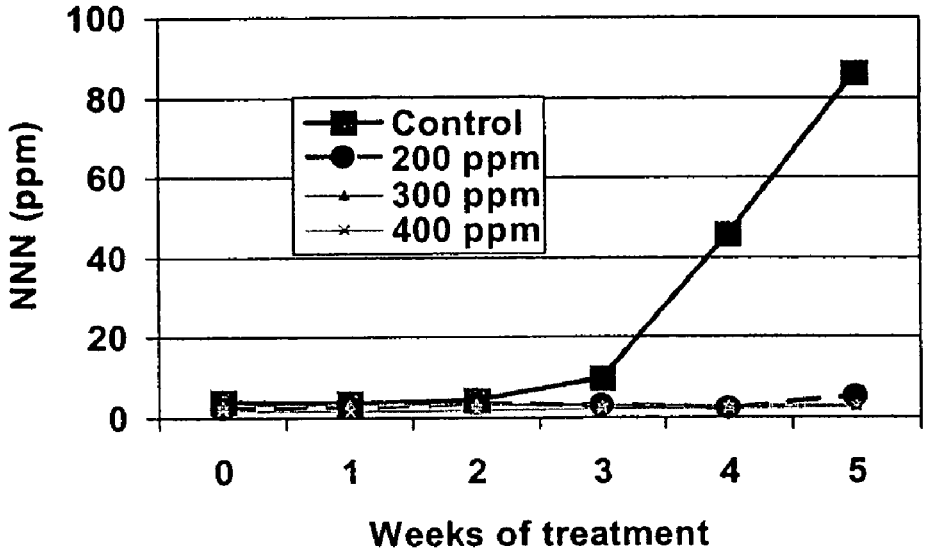
FIG. 1 illustrates NNN accumulation in lamina of cured TRM converter tobacoo in 5 weeks at 90% RH micro-barn condition (Control vs. Chlorate).

The methods of the present invention provide convenient and cost effective methods of reducing both the numbers and/or activity of bacterial and/or fungal populations and, therefore, TSNAs formed during the tobacco curing process. In an important aspect, tobacco leaves are treated prior to or during flue curing by contacting the leaves with chlorate, sulfur dioxide, or ozone either alone or in any combination. In another important aspect, chlorate, sulfur dioxide, or ozone either alone or in any combination can be used to treat tobacco by contacting them with green (e.g., growing or harvested) tobacco plants or leaves, partially cured tobacco, or cured tobacco. The treatment is effective for killing or disrupting the biological activity of the bacteria and/or fungi present on the tobacco leaves. It is crucial that the treatment have minimal chemical reactivity with the tobacco leaf itself.

Tobacco leaf or leaves, or uncured tobacco leaf or leaves, as used herein, is meant to include flue-cured, air-cured and fire-cured tobacco leaves which are green or partially cured. Thus, tobacco leaf or leaves may indicate the individual primed leaves of tobacco or the stalk-cut leaves as attached to the stalk of the burley, Maryland (air-cured) dark, or cigar, flue-cured, or oriental tobacco plant or as individual leaves which have been primed from the stalk of flue-cured, burley, Maryland, Virginia, dark, cigar or oriental tobacco.

Cured tobacco indicates tobacco leaves which have completed the curing process.

Harvesting tobacco is meant to include both priming and stalk-cutting of tobacco.

Priming is meant to include removal of a tobacco leaf from a growing or harvested tobacco plant.

Practitioners in the art will recognize that the number, concentration and length of treatments can be adjusted to take into account numerous factors, such as the type of leaf and, therefore, the curing process being used (fire-cured, flue-cured or air-cured), the temperature and humidity conditions during curing, the length of time the leaves require to complete each step of curing, the appearance of the leaves themselves and the amount of bacteria or fungal growth present, as well as environmental conditions affecting the curing process, for example. Treatments include an effective amount of chlorate, sulfur dioxide, or ozone, wherein an effective amount is the amount applied over a specified exposure time, alone or in combination with other treatments described herein, sufficient to significantly reduce or eliminate bacterial populations, bacterial activity and/or fungal growth from the tobacco leaves, and to reduce or eliminate the amount of tobacco specific nitrosamines in the cured tobacco as compared to untreated tobacco.

Treatment can be effected in any manner known in the art. For example, machines may be used to generate gases or aerosols on site as needed, or the treatment gas or solution can be pumped into the curing barn or other structure as needed. The treatment may also be generated on site from a dry precursor which reacts with aqueous liquid to form the treatment composition.

Treatments may be adjusted so that release of a treatment is triggered by a rise in humidity or temperature beyond a certain level during curing. In this manner, the administration of the treatment is automatic, and can coincide with the appearance of conditions favorable to bacterial and fungal growth, such as increased humidity and/or heat.

Use of Chlorate to Reduce TSNA Formation

The invention describes a method to control or reduce bacterial/fungal populations in or on tobacco by applying chlorate salts in liquid, dry or other forms to the tobacco leaf, entire plant, or plant part before, during or after the tobacco is cured. The chlorate salts may include but are not limited to sodium chlorate, potassium chlorate, other salts of chlorate, or combinations of chlorate salts that may be applied to the tobacco before harvest, after harvest and before curing, during the curing process, or after the tobacco is cured. The chlorate salts may also be applied, for example, by spraying about 150 to about 250 ppm, preferably about 200 ppm sodium chlorate aqueous solution onto the plants, leaves or other tobacco plant parts, immersion of the tobacco plants into a liquid solution of chlorate salts, dusted onto the tobacco in a dry form, or applied as an aerosol. The tobacco may be cured by various methods including air-curing, flue- or heat-curing, fire-curing, or sun-curing.

Generally, those microbes that are non-nitrate-reducers or lack nitrate reductase would be unaffected by the chlorate. Thus, the use of sodium chlorate in the curing process, either when it is applied directly to the leaf matrix or indirectly in the curing environment, may control the nitrate-reducing bacteria and eliminate nitrite formation. Consequently, reducing TSNA formation during the tobacco curing process.

Use of Sulfur to Reduce TSNA Formation

The invention describes a method to control or reduce bacterial and/or fungal populations in or on tobacco by applying sulfur dioxide to the tobacco leaf, entire plant, or plant part before, during or after the tobacco is cured. Tobacco leaves or intact tobacco plants may be exposed to $SO_2$ as a gas by burning elemental sulfur or direct release of $SO_2$ in the curing barn or other structure in which the tobacco is contained. The $SO_2$ is intended to reduce microbial activity on the leaf surface of tobacco before, during or after curing and thus reduce or limit the formation of TSNA's.

The source of sulfur dioxide ($SO_2$) may include sulfur dioxide ($SO_2$) gas, or burning of any form of sulfur containing material, such as an agricultural grade of sulfur. The treatment may be applied to the tobacco before harvest, after harvest and before curing, during the curing process, or after the tobacco is cured in amounts effective for controlling or reducing bacteria and/or fungal populations in or on tobacco.

Use of Ozone to Reduce TSNA Formation

Ozone ($O_3$) is a gas that may be supplied via a generator or from a pressurized cylinder to the ambient atmosphere present in the curing barn or other structure used to cure the tobacco, process the tobacco, or store the tobacco at any stage from field harvest to tobacco product manufacture. The concentration of the supplied ozone required to meet required levels of efficacy is between about 0.0005 to about 5.0 ppm, preferably about 0.01 and about 0.8 ppm, more preferably 0.1 to 0.5 ppm in the gas mixture. The tobacco may be cured by various methods including air-curing, flue- or heat-curing, and fire-curing. The tobacco may include burley, Virginia, Maryland, dark air-cured or dark fire-cured, flue-cured, or cigar tobaccos.

At the yellowing stage of leaf curing, ozone is generated in the curing barn by placing an ozone generator inside the structure, or ozone is supplied via a pipe connected from the curing barn to an externally-located, ozone generator. The ozone generator could also be placed proximate to a primary air-intake of the curing barn. Ideally, ozone concentration should be maintained from between about 0.0005 to about 5.0 ppm, preferably about 0.01 and about 0.8 ppm, more preferably 0.1 to 0.5 ppm from end of yellowing stage to end of curing, or at similar concentrations during other stages of leaf curing, processing, or storage.

EXAMPLES

Example 1

300 ppm $NaClO_3$ aqueous solution with a small amount of kitchen soap as a surfactant was used as pre-curing treatment with the following procedures/treatments for 2004 testing (a) spray 1 day before harvest, (b) spray 1 day before and 1 day after harvest and (c) 7 days before and 1 day before. Results of further chlorate treatments are set forth in FIG. 1 which illustrates NNN accumulation in lamina of cured TRM converter tobacoo in 5 weeks at 90% RH micro-barn condition (Control vs. Chlorate).

Example 2

Figure 2:
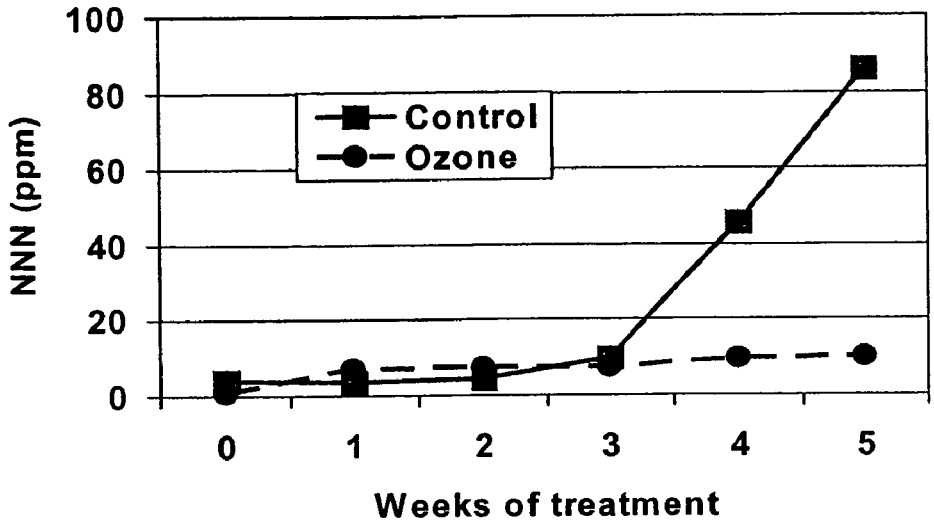
FIG. 2 illustrates NNN accumulation in lamina of cured TRM converter tobacoo in 5 weeks at 90% RH micro-barn condition (Control vs. Ozone).

Results of ozone treatments are set forth in FIG. 2 which illustrates NNN accumulation in lamina of cured TRM converter tobacoo in 5 weeks at 90% RH micro-barn condition (Control vs. Ozone).

What is claimed is:

1. A method for reducing formation of tobacco specific nitrosamines comprising contacting tobacco leaves with a solid consisting essentially of an amount of chlorate effective for reducing bacterial and/or fungal populations on or in the tobacco leaves, wherein the contacting occurs from one day before to one day after harvest.

2. The method of claim 1 wherein the chlorate is a chlorate salt.

3. The method of claim 2 wherein the chlorate salt is selected from the group consisting of sodium chlorate, potassium chlorate, calcium salt and mixtures thereof.

4. The method of claim 1 wherein the tobacco leaves are contacted with 100 to 400 ppm chlorate.

5. The method of claim 1, wherein the contacting occurs one day before harvest.

6. The method of claim 1, wherein the contacting occurs one day after harvest.

7. The method of claim 1, wherein contacting the tobacco leaves with the solid comprises dusting the leaves with the chlorate.

* * * * *

UNITED STATES PATENT AND TRADEMARK OFFICE

CERTIFICATE OF CORRECTION

PATENT NO. : 7,992,575 B2
APPLICATION NO. : 11/363664
DATED : August 9, 2011
INVENTOR(S) : Mingwu Cui It is certified that error appears in the above-identified patent and that said Letters Patent is hereby corrected as shown below:

Title Page, Inventors, Mark T. Nielsen, please delete "Nicholsville," and insert --Nicholasville-- therefor;

Title Page, References Cited, Other Publications, please delete "Cornell Univeristy" and insert --Cornell University-- therefor;

Title Page, References Cited, Other Publications, please delete "Michigan State Univeristy" and insert --Michigan State University-- therefor;

Title Page, References Cited, Other Publications, please delete "Oregon State Univeristy" and insert --Oregon State University-- therefor.

Signed and Sealed this
Sixth Day of March, 2012

David J. Kappos

David J. Kappos
*Director of the United States Patent and Trademark Office*